United States Patent [19]

D'Oro et al.

[11] 4,353,042

[45] Oct. 5, 1982

[54] DIFFERENTIAL PHASE SHIFTER FOR A WAVEGUIDE CARRYING HIGH-POWER MICROWAVES

[75] Inventors: Enzo C. D'Oro, Monza; Girolamo Ocera, Palermo, both of Italy

[73] Assignee: Italtel S.p.A., Milan, Italy

[21] Appl. No.: 216,905

[22] Filed: Dec. 16, 1980

[30] Foreign Application Priority Data

Dec. 18, 1979 [IT] Italy ..... 28145 A/79

[51] Int. Cl.[3] ..... H01P 1/19

[52] U.S. Cl. ..... 333/24.1; 333/158

[58] Field of Search ..... 333/24.1, 24.2, 24.3, 333/158

[56] References Cited

U.S. PATENT DOCUMENTS 3,197,718 7/1965 Sigrist et al. ..... 333/24.2

3,623,149 11/1971 Smith ..... 333/24.1 X

*Primary Examiner*—Paul L. Gensler

*Attorney, Agent, or Firm*—Karl F. Ross

[57] ABSTRACT

A rectangular waveguide energized in the $TE_{10}$ mode is externally provided on at least one of its major surfaces with one or more pairs of ferrite cores rising from that surface on opposite sides of its electric plane, an end face of each ferrite core being aligned with an aperture in the guide surface whereby two counterrotating magnetic fields in the interior of the guide induce corresponding fields in the two cores. The induced magnetic fields travel outward in the cores and are reflected at their remote ends for return to the guide with a phase shift controlled by a unipolar biasing current traversing a pair of coils which are respectively wound about these cores to generate two mutually opposite magnetic fields therein. The cores and their coils may be spacedly surrounded by an enclosure for the forced circulation of a cooling fluid therearound.

8 Claims, 2 Drawing Figures

DIFFERENTIAL PHASE SHIFTER FOR A WAVEGUIDE CARRYING HIGH-POWER MICROWAVES

FIELD OF THE INVENTION

Our present invention relates to a differential phase shifter for a rectangular waveguide, especially one designed to carry high-power microwaves.

BACKGROUND OF THE INVENTION

Differential phase shifters conventionally used in waveguides comprise toroidal ferrite bodies whose central bores contain wiring for the generation of an axial magnetic field which controls the extent of the phase shift introduced thereby; the magnitude of this phase shift depends on the direction of the electromagnetic wave propagating through the guide and is also a function of the length of the body, as is the attenuation caused by that body. This attenuation remains substantially constant until the magnetic field generated in the ferrite attains a critical level, increasing rapidly beyond that point.

The latter property has heretofore prevented the use of such phase shifters in guide structures for high-power microwaves, such as circulators or tuners for power magnetrons.

In order to dissipate the heat generated by the transfer of electromagnetic energy to the ferrite body, dielectric inserts of good thermal conductivity are generally disposed alongside that body. The presence of this dielectric material, together with the dielectric property of the ferrite, increases the equivalent width of the guide and thus favors the propagation of higher modes therethrough. The suppression of these higher modes requires the provision of absorptive masses along the sidewalls of the waveguide.

OBJECTS OF THE INVENTION

An object of our present invention, therefore, is to provide an improved differential phase shifter adapted to be used with high-power microwaves propagating in a rectangular guide.

Another object is to provide a phase shifter of the type referred to which obviates the need for the provision of heat-dissipating and higher-mode-absorbing inserts in such a guide.

SUMMARY OF THE INVENTION

We attain these objects, in accordance with our present invention, by the provision of one or more pairs of preferably cylindrical ferrite bodies rising externally of a rectangular waveguide from at least one sidewall defining one of its major surfaces, these bodies being disposed on opposite sides of a plane (generally known as the electric plane) bisecting that sidewall. The latter is provided with apertures which are surrounded by ferromagnetic collars and confront proximal end faces of the ferrite bodies embraced by these collars whereby two conterrotating magnetic fields, present in the so-called magnetic plane parallel to the major guide surfaces, induce corresponding fields traveling outward in the two bodies and returning after reflection at remote end faces thereof so as to re-enter the waveguide with identical phase shifts imparted thereto in these bodies. The magnitude of the phase shifts is controlled by opposite unidirectional magnetic fields, which could be constant or variable by external means, induced in the bodies by conductor means juxtaposed therewith. In the embodiment specifically described hereinafter, the ferrite bodies are cylindrical with the conductor means forming coils wound around them in equal numbers of turns; thus, we shall refer to these bodies hereinafter as ferrite cores.

Since the direction of wave propagation determines the sense of rotation of the circularly polarized high-frequency magnetic field induced in each ferrite core, and since this sense of rotation is maintained upon reflection of the field at the remote end face of that core, the unipolar control field oriented along the core axis causes a phase shift which changes when the propagation direction is reversed. The coupling between the waveguide and the ferrite cores, and thus the amount of signal power diverted into the cores, depends on the size of the wall apertures as well as on their distance from the proximal core faces; these parameters can be readily chosen to prevent any magnetization of the cores beyond the critical limit which would unduly attenuate the phase-shifted signal component. If the extent of the differential phase shift obtainable from a single pair of external ferrite cores is insufficient, one or more additional core pairs of preferably identical shape and biasing-field strength may be provided on the same and/or the opposite major guide surface.

BRIEF DESCRIPTION OF THE DRAWING

The above and other features of our invention will now be described in detail with reference to the accompanying drawing in which.

SPECIFIC DESCRIPTION

Figure 2:
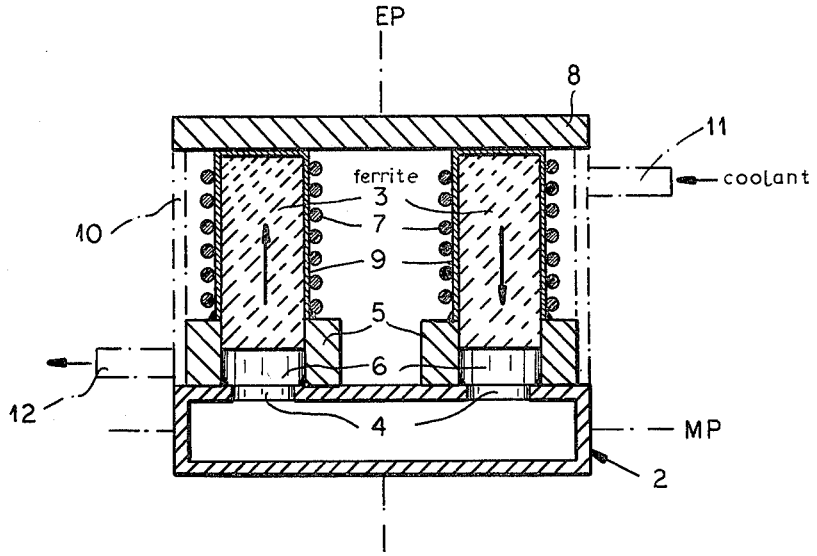
FIG. 2 is a cross-sectional view taken on the line II—II of FIG. 1.

As shown in the drawing, a rectangular waveguide 2 has a sidewall 1 parallel to its magnetic plane MP, defining one of its major surfaces. Two pairs of ferrite cores 3, symmetrically disposed with reference to the electric plane EP of the guide, rise from the outer surface of sidewall 1 to which they are attached with the aid of respective collars 5 of iron or other electrically conductive ferromagnetic material surrounding respective apertures 4 of somewhat smaller diameter formed in that wall. The electrical continuity of sidewall 1 in the region of its apertures 4 is maintained by a conductive sheath 9 surrounding each core 3 on all sides except at its end face confronting the corresponding aperture 4; while this sheath could be a separate metal jacket, we have shown it as a metallic coating adhering to the ferrite core and facilitating its mechanical connection with the associated collar 5 by being soldered or welded thereto, a similar connection existing between the collar and wall 1. At the end faces of cores 3 remote from guide 2, coatings 9 also act as virtually perfect reflectors for two circularly polarized magnetic fields M′, M″ existing in guide 2 at locations aligned with apertures 4; as schematically indicated in FIG. 1, the vectors of fields M′ and M″ are assumed to rotate clockwise and counterclockwise, respectively, with a given direction of propagation of a high-frequency signal wave through the guide.

Figure 1:
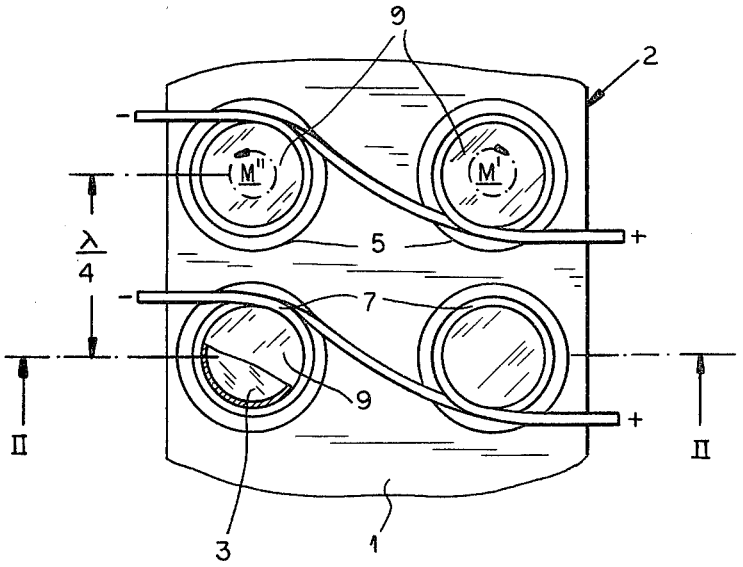
FIG. 1 is a top view of a portion of a rectangular waveguide equipped with a differential phase shifter according to our invention.

The coated ferrite cores 3 are surrounded by suitably insulated coils 7 connected to a source of preferably adjustable direct current schematically represented by plus and minus signs in FIG. 1. The two coils 7 of a core pair, or even all the coils of several such pairs, can be connected in series as illustrated for each pair in FIG. 1; if, however, the biasing current traversing these coils is to be subject to rapid variations, we prefer to connect them in parallel in order to reduce the inductance of the control circuit.

As indicated by vertical arrows in FIG. 2, the coils 7 are so wound that the magnetic fields generated thereby in the axial direction of each cylindrical core 3 of a pair are oppositely oriented. In order to reduce the magnetic reluctance of the flux path, we prefer to provide a bridge 8 of iron or other ferromagnetic material spanning the remote end faces of the cores and to make at least a central portion of guide wall 1, interconnecting the collars 5, of similar material so as to provide a substantially closed magnetic circuit. Bridge 8 is omitted in FIG. 1.

In operation, magnetic field M'—rotating clockwise—induces a similar field in the right-hand core 3 of each pair; the induced field is reflected at the far end of the core and, with its sense of rotation unchanged, returns to the interior of guide 2 after undergoing a phase shift determined by the intensity of the magnetizing current passing through the corresponding coil 7. A like phase shift is experienced by a signal component—induced by magnetic field M"—rotating counterclockwise in the left-hand core of each pair where the magnetic control field is oppositely oriented. If the sense of rotation of fields M', M" were reversed by a change in the direction of wave propagation through guide 2, the phase shift would be of different magnitude. The guide is assumed to be energized in the $TE_{10}$ mode.

Advantageously, as indicated in FIG. 1, the two pairs of cores 3 are separated in the longitudinal direction of the guide by a center-to-center spacing equal to a quarter wavelength of the high-frequency signal propagating therethrough. This enables the suppression of regressive components, moving against the direction of the principal field, which are due to a slightly elliptical mode of polarization of the magnetic fields in the ferrite cores resulting from the excitation of higher modes by the couplings 4, 5. Such a quarter-wavelength spacing may also be maintained when the cores of a pair are longitudinally offset from each other instead of being aligned as shown.

If air cooling of cores 3 is insufficient, we may spacedly surround them with an enclosure 10 (as indicated in phantom lines in FIG. 2) having an inlet 11 and an outlet 12 for the forced circulation of air or some other cooling fluid, such as that used in a power magnetron to which the guide 2 is connected.

We claim:

1. In a waveguide of rectangular cross-section with two major surfaces defined by conductive sidewalls paralleling a magnetic plane in which a propagating electromagnetic wave gives rise to two counterrotating magnetic fields on opposite sides of an electric plane perpendicular thereto, the combination therewith of:

at least one pair of ferrite bodies rising externally of said waveguide from at least one of said sidewalls on opposite sides of said electric plane, said one of said sidewalls being provided with apertures confronting proximal end faces of said bodies for enabling said counterrotating fields to induce corresponding fields traveling outward in said bodies and returning after reflection at remote end faces thereof to said waveguide with identical phase shifts experienced in said bodies, said apertures being surrounded on the outer surface of said one of said sidewalls by ferromagnetic collars respectively embracing said bodies at said proximal end faces thereof; and conductor means juxtaposed with said bodies for inducing therein opposite unidirectional magnetic fields controlling the magnitude of said phase shifts.

2. The combination defined in claim 1 wherein said collars are part of a substantially closed magnetic circuit including a ferromagnetic portion of said one of said sidewalls extending between said apertures and further including a ferromagnetic bridge spanning said remote end faces of said bodies.

3. The combination defined in claim 1 wherein said collars are part of a conductive structure, including a pair of metallic sheaths respectively surrounding said bodies, providing electrical continuity of said one of said sidewalls in the region of said apertures.

4. The combination defined in claim 3 wherein said sheaths are coatings on surfaces of said bodies other than said proximal end faces.

5. The combination defined in claim 1, 2, 3 or 4 wherein said one of said sidewalls is externally provided with another pair of ferrite bodies, substantially identical with said one pair of bodies, aligned with other apertures in said one of said sidewalls and juxtaposed with conductor means for inducing therein opposite unidirectional magnetic fields establishing phase shifts equal to those established by said one pair of bodies.

6. The combination defined in claim 5 wherein corresponding bodies of said pairs are longitudinally separated with a center-to-center spacing of a quarter wavelength of the electromagnetic wave propagating through said waveguide.

7. The combination defined in claim 1, 2, 3 or 4 wherein said bodies are cylindrical and said conductor means comprises respective coils wound about said bodies with the same number of turns and connected to a common source of current.

8. The combination defined in claim 1, 2, 3 or 4, further comprising an enclosure spacedly surrounding said bodies for circulating a cooling fluid therearound.

* * * * *